US007047849B2

(12) United States Patent
Lai

(10) Patent No.: US 7,047,849 B2
(45) Date of Patent: May 23, 2006

(54) WRENCH CAPABLE OF COUNTING THE NUMBER OF TIMES ITS TORQUE REACHES SET VALUES

(75) Inventor: Ching-Hua Lai, Taichung Hsien (TW)

(73) Assignee: King Tony Tools Co., Ltd., Taichung Hsien (TW)

( * ) Notice: Subject to any disclaimer, the term of this patent is extended or adjusted under 35 U.S.C. 154(b) by 0 days.

(21) Appl. No.: 10/762,940

(22) Filed: Jan. 22, 2004

(65) Prior Publication Data

US 2005/0160885 A1 Jul. 28, 2005

(51) Int. Cl.
*B24B 23/147* (2006.01)

(52) U.S. Cl. ..... 81/479; 73/862.23; 81/481

(58) Field of Classification Search ..... 81/467, 81/478–483, 468; 73/862.23
See application file for complete search history.

(56) References Cited

U.S. PATENT DOCUMENTS 3,140,623 A * 7/1964 Van Hoose ..... 81/483
3,577,815 A * 5/1971 Bergquist ..... 81/483
4,969,105 A * 11/1990 Gaenssle ..... 73/862.23
5,537,877 A * 7/1996 Hsu ..... 73/862.23
6,463,834 B1 * 10/2002 Kemp et al. ..... 81/483
6,655,242 B1 * 12/2003 Gambarini ..... 81/479

FOREIGN PATENT DOCUMENTS

DE 3421212 A1 * 12/1985

* cited by examiner

*Primary Examiner*—Hadi Shakeir
(74) *Attorney, Agent, or Firm*—Alan D. Kamrath; Nikolai & Mersereau, P.A.

(57) ABSTRACT

A wrench includes a pipe, a lever, a first wedge, a second wedge, an elastic element, a counter and a sensor. The lever includes a portion put in and pivotally connected with the pipe. The first wedge is attached to the portion of the lever. The second wedge is in contact with the first wedge. The elastic element biases the second wedge against the first wedge. The counter is installed on the pipe. The sensor signals the counter every time it senses movement of the first wedge past the second wedge.

14 Claims, 12 Drawing Sheets

WRENCH CAPABLE OF COUNTING THE NUMBER OF TIMES ITS TORQUE REACHES SET VALUES

FIELD OF INVENTION

The present invention relates to a wrench that counts the number of times its torque reaches set values.

BACKGROUND OF INVENTION

FIGS. 10–12 show a wrench 100 that signals every time its torque reaches a set value. The wrench 100 includes a pipe 102 and a lever 110. The pipe 102 includes first and second open ends and defines a slot 104. The lever 110 includes a first end for engagement with a socket and a second end inserted in the pipe 102. A concave face 112 is formed at the second end of the lever 110. The concave face 112 defines two grooves 114 each for receiving a roller 116. The lever 110 is pivotally connected with the pipe 102 via a pin 120.

A roller 130 is attached to a carriage 132 via a pin 134, and they are put in the pipe 102. The roller 130 is put between the rollers 116. A spring 136 is put in the pipe 102 against the carriage 132. A tube 138 includes a closed end and an open end. A hole 140 is defined in an external face of the tube 138. A thread 142 is formed on an internal face of the tube 138. The tube 138 is put in the pipe 102 against the spring 136. A pin 106 is fit in the hole 140 through the slot 104. Thus the tube 138 is movable but non-rotational in the pipe 102. A spring 144 is put into the tube 138 through the open end. A shaft 146 includes a thread 148 formed thereon. The shaft 146 is put in the pipe 102. The thread 148 is engaged with the thread 142. A bearing 150 is kept in the pipe 102 via two pins 108.

A grip 214 is provided around the pipe 102. The grip 214 includes an enlarged portion 210 extending from an end, a window 211 defined in the enlarged portion 210, a tab 212 extending from the end in the window 211 and an indicator 213 formed on the tab 212. A lens 220 is fit in the window 211. A knob 230 is formed with a scale 231. The knob 230 is attached to the shaft 146.

Rotation of the knob 230 relative to the pipe 102 causes rotation of the shaft 146 relative to the tube 138 so as to change a force between the roller 130 and the rollers 116 via the spring 136. The indicator 213 and the scale 231 show values set for torque in the wrench 100. Every time the torque in the wrench 100 reaches a set value, the roller 130 rolls past one of the rollers 116. Every time this happens, some parts wear. Such wearing eventually affects the precision in setting the values. Hence, insufficient or excessive torque is exerted on a bolt or nut via the wrench 100. This could result in disasters if the wrench 100 is used to make aircrafts for example. To avoid this, the parts must be replaced before they wear out. In practice, replacement is performed after a certain number of times the torque in the wrench 100 reaches the values. To this end, the number of times the torque in the wrench 100 reaches the set values must be counted. However, automatic counting of the number is not possible with the wrench 100.

The present invention is therefore intended to obviate or at least alleviate the problems encountered in the prior art.

SUMMARY OF INVENTION

It is the primary objective of the present invention to provide a wrench that counts the number of times its torque reaches set values.

According to the present invention, a wrench includes a pipe, a lever, a first wedge, a second wedge, an elastic element, a counter and a sensor. The lever includes a portion put in and pivotally connected with the pipe. The first wedge is attached to the portion of the lever. The second wedge is in contact with the first wedge. The elastic element biases the second wedge against the first wedge. The counter is installed on the pipe. The sensor signals the counter every time it senses movement of the first wedge past the second wedge.

Other objectives, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
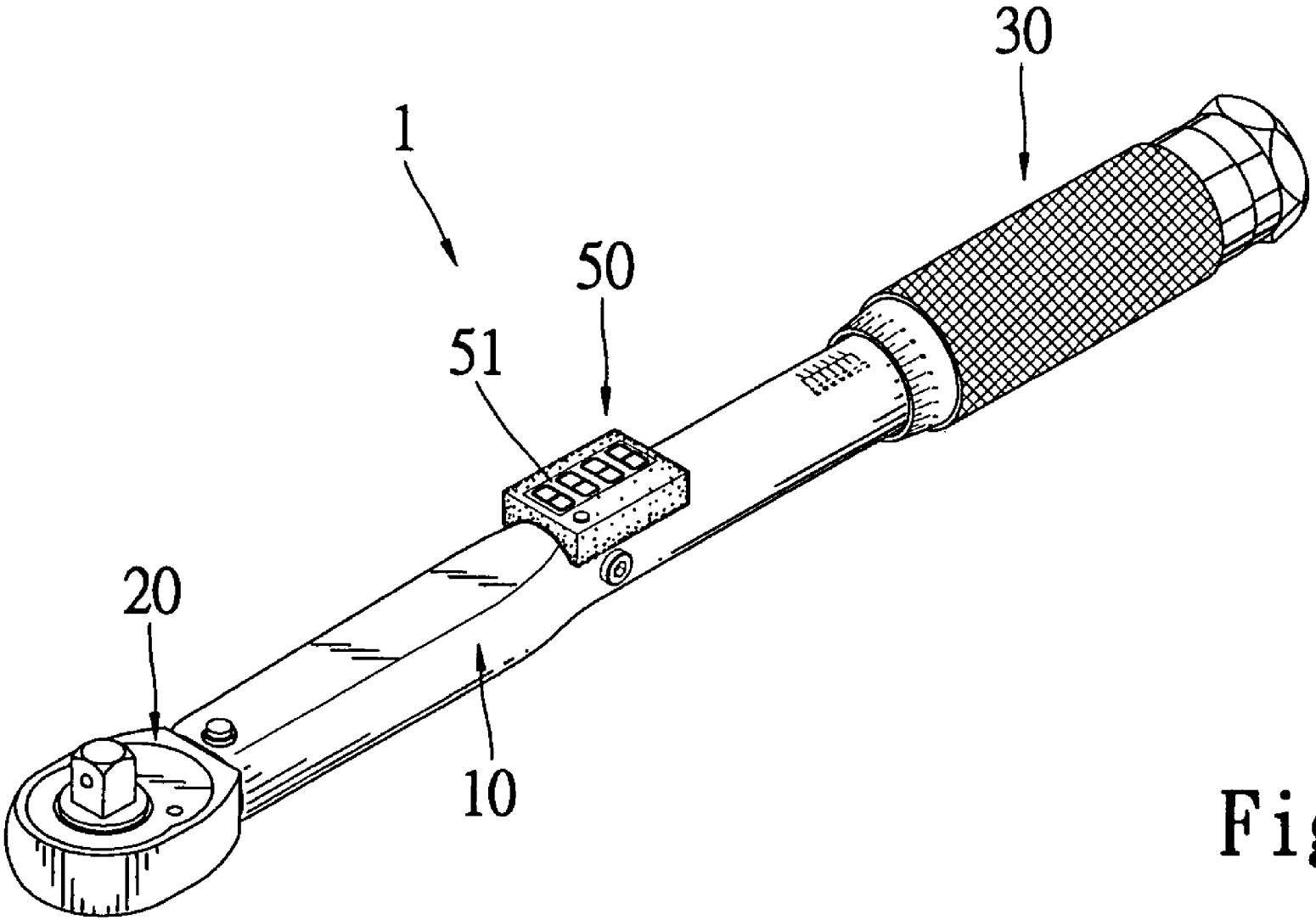
FIG. 1 is a perspective view of a wrench that counts the number of times its torque reaches set values according to a first embodiment of the present invention.

FIG. 1 shows a wrench 1 that counts the number of times its torque reaches set values according to a first embodiment of the present invention. The wrench 1 includes a pipe 10, a lever 20 and a grip 30.

Figure 2:
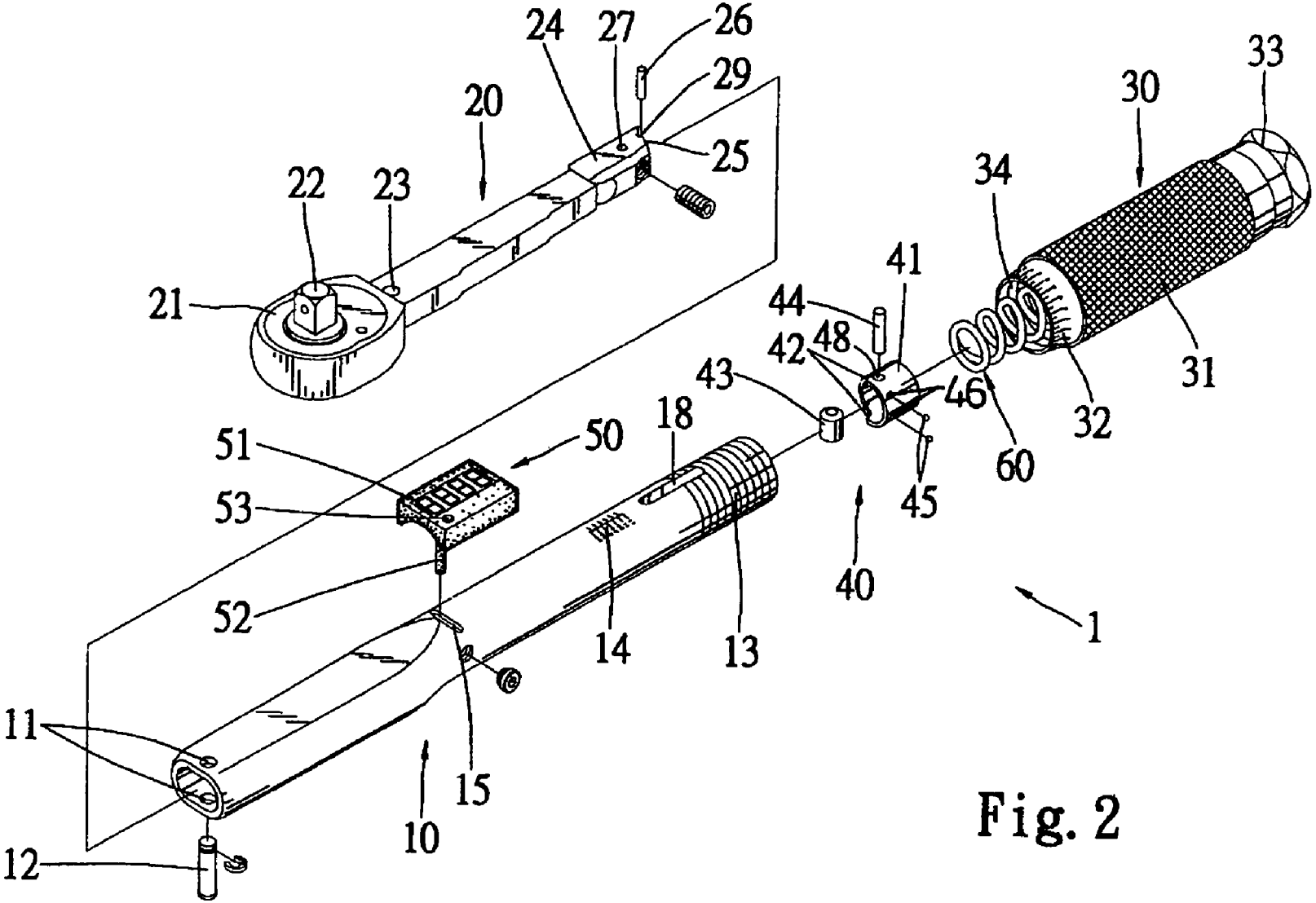
FIG. 2 is an exploded view of the wrench of FIG. 1.
Figure 3:
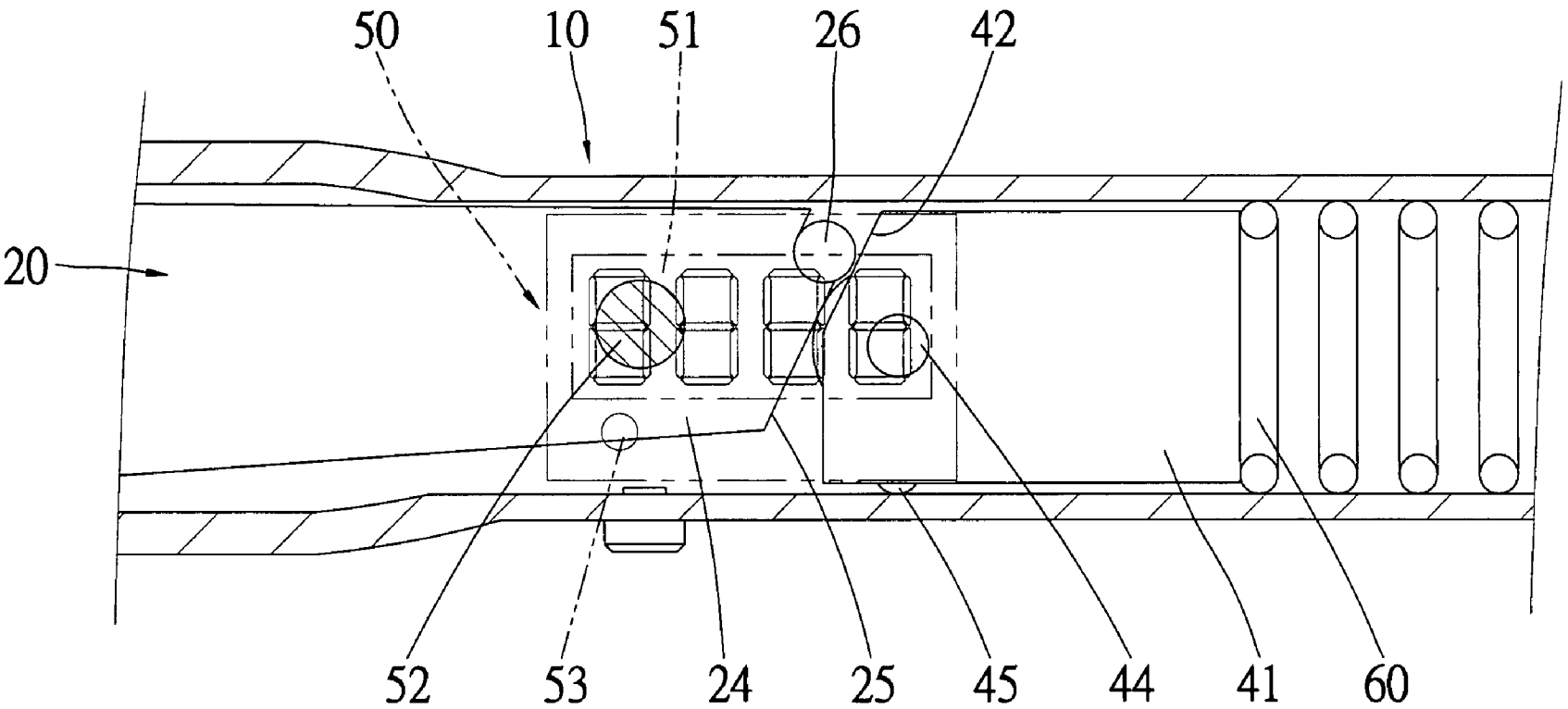
FIG. 3 is an enlarged cross-sectional view of the wrench of FIG. 1.

Referring to FIGS. 2 and 3, the pipe 10 includes a first open end and a second open end opposite to the first open end. The pipe 10 defines two apertures 11 near the first open end. The pipe 10 is formed with a thread 13 near the second end and a scale 14 near the thread 13. A transverse slot 15 and a longitudinal slot 18 are defined in the pipe 10.

The lever 20 includes a head 21 formed at an end and a wedge 24 formed at an opposite end. From the head 21 extends an insert 22 for insertion in a socket (not shown) for driving the bolt or nut. The lever 20 can drive the bolt or nut in selective one of two directions. The lever 20 defines an aperture 23 near the head 21. The wedge 24 includes an inclined face 25 defining a groove 29. A roller 26 is put in the groove. The wedge 24 defines a hole 27. The pipe 10 receives the lever 20 except for the head 21. The slot 15 is aligned with the hole 27. A pin 12 is inserted in the apertures 11 and 23 so as to pivotally connect the lever 20 to the pipe 10.

A roller assembly 40 includes a wedge 41, a roller 43 and a pin 44 for attaching the roller 43 to the wedge 41. The wedge 41 is in the form of a collar with two inclined edges 42 and defines two holes 46 each for receiving a ball 45. The wedge 41 further defines a hole 48. The assembly 40 is put in the pipe 10. The roller 43 is located against the roller 26. The balls 45 are located against the pipe 10. A pin 44 is fit in the hole 48 through the slot 18 so that the wedge 41 is movable but non-rotational in the pipe 10.

A spring 60 is put in the pipe 10 against the wedge 41.

The grip 30 is hollow and includes a first open end and a second open end opposite to the first open end. Near the first open end, on an internal face of the grip 30 extends a thread 34 for engagement with the thread 13. Near the first open end, a scale 32 is formed on an external face of the grip 30. A cap 33 is used to seal the second open end of the grip 30. The external face of the grip 30 includes knurling 31 intermediate the scale 32 and the cap 33.

An electrical counter 50 includes a display 51 for providing a reading, a button 53 that can be pushed to reset the reading and a sensor 52 in the form of a trigger extending a side thereof. The electrical counter 50 is attached to the pipe 10. The sensor 52 is inserted in the hole 27 through the slot 15.

Figure 4:
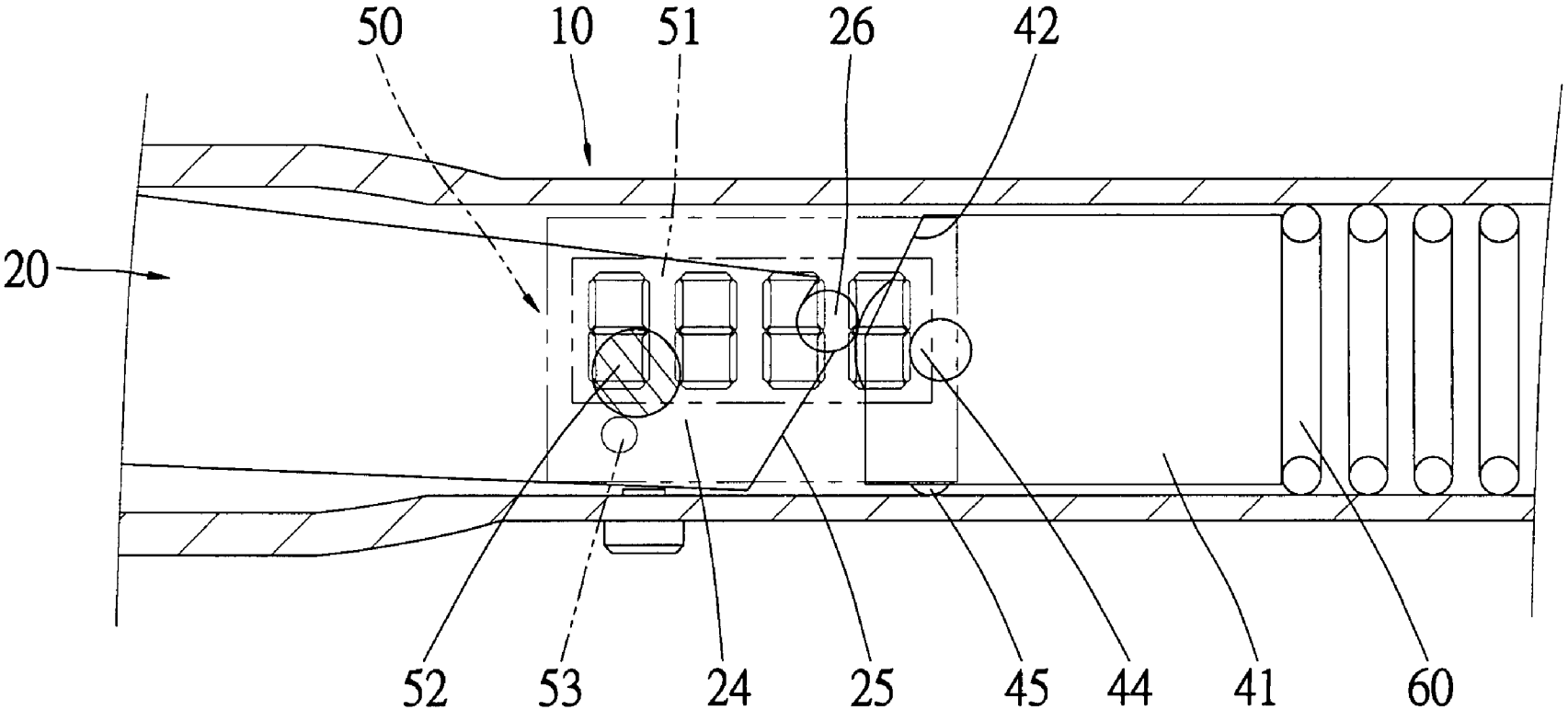
FIG. 4 is similar to FIG. 3 but shows the wrench in another position.
Figure 5:
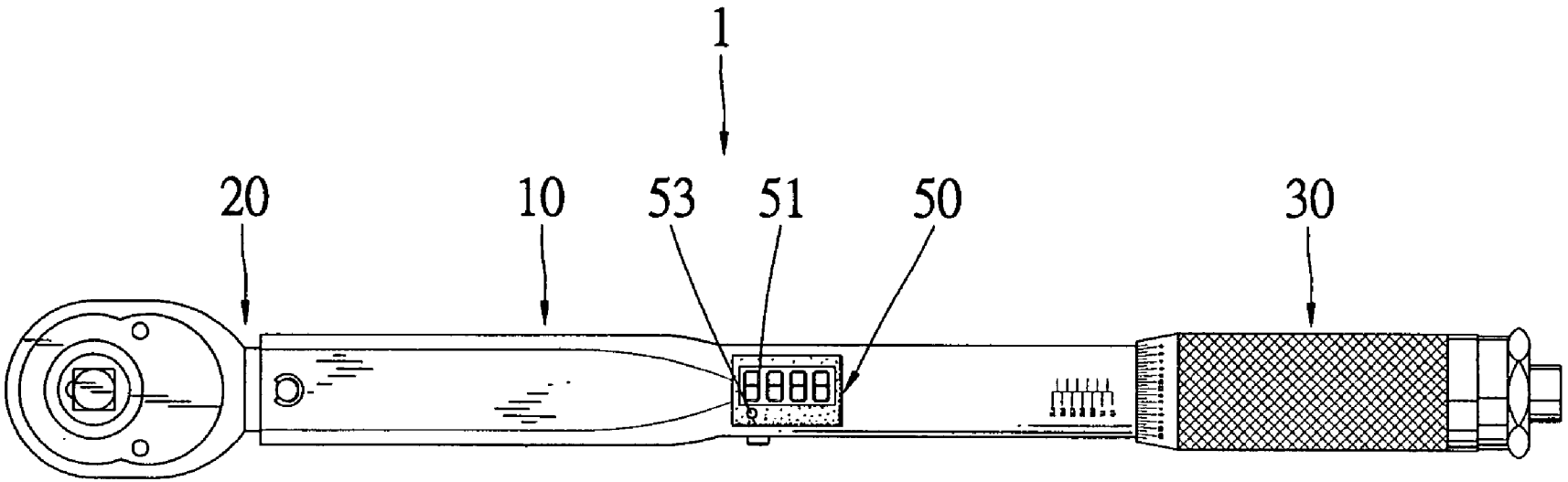
FIG. 5 is a top view of the wrench of FIG. 1.

Every time the torque in the wrench 1 reaches a set value, the roller 26 rolls over the roller 43. Accordingly, the sensor 52 moves from a position shown in FIG. 3 to another position shown in FIG. 4 so as to actuate the electrical counter 50 shown in FIG. 5. Thus, the number of the times the torque in the wrench 1 reaches set values is counted via the electrical counter 50.

Figure 6:
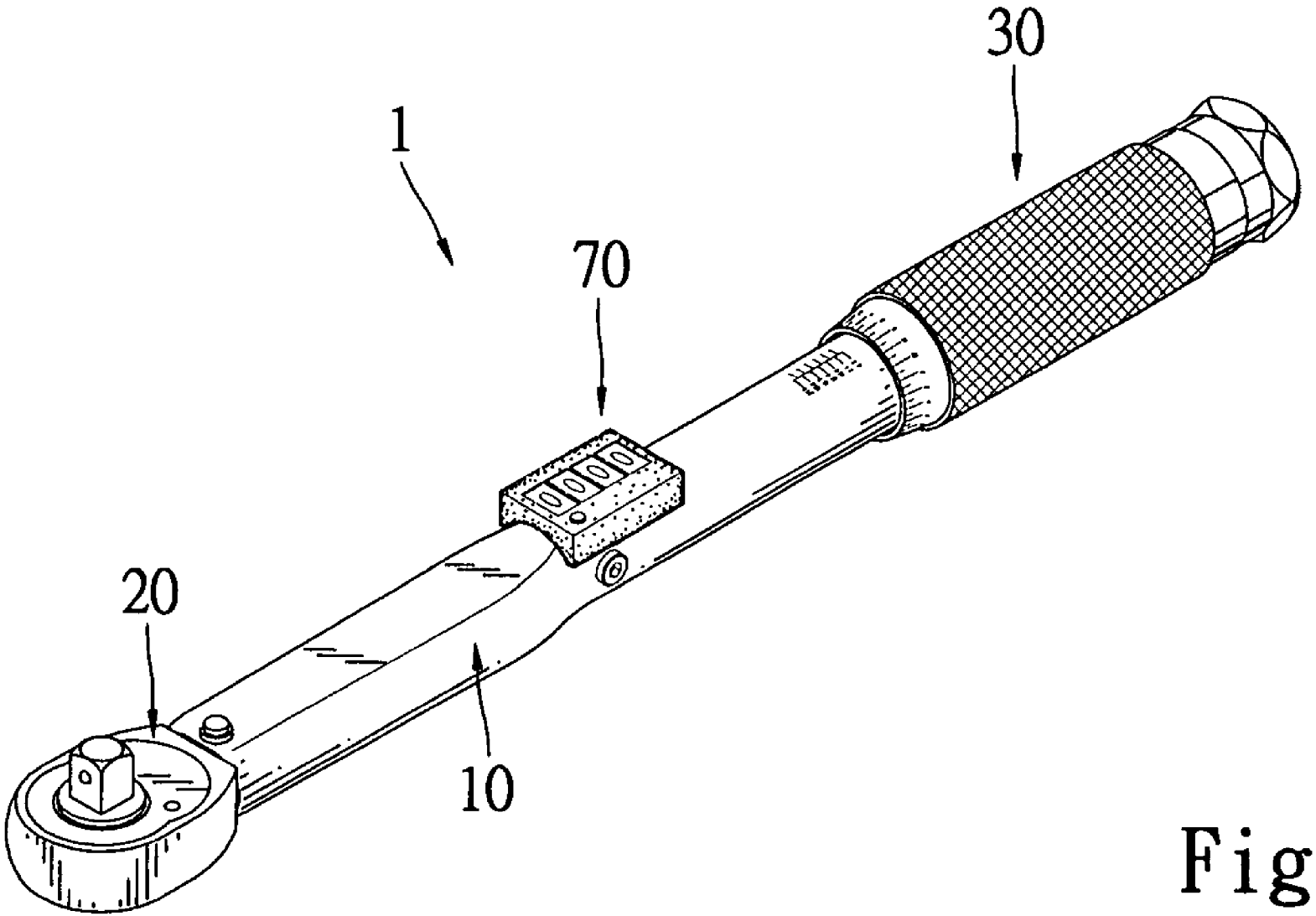
FIG. 6 is a perspective view of a wrench that counts the number of times its torque reaches set values according to a second embodiment of the present invention.

FIG. 6 shows a perspective view of a wrench that counts the number of times its torque reaches set values according to a second embodiment of the present invention. The second embodiment is identical to the first embodiment except for including a mechanical counter 70 instead of the electrical counter 50.

Figure 7:
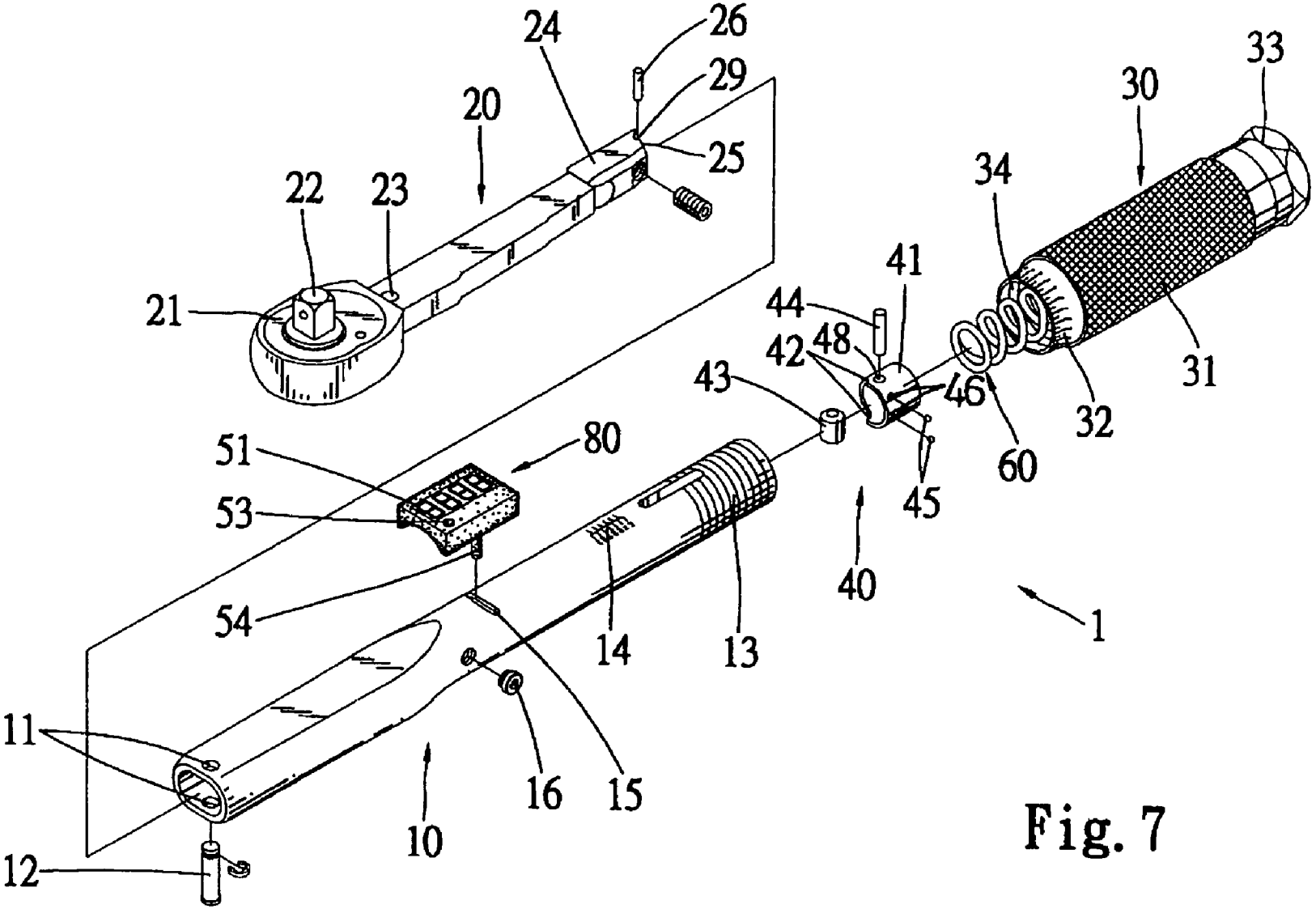
FIG. 7 is an exploded view of a wrench that counts the number of times its torque reaches set values according to a third embodiment of the present invention.
Figure 8:
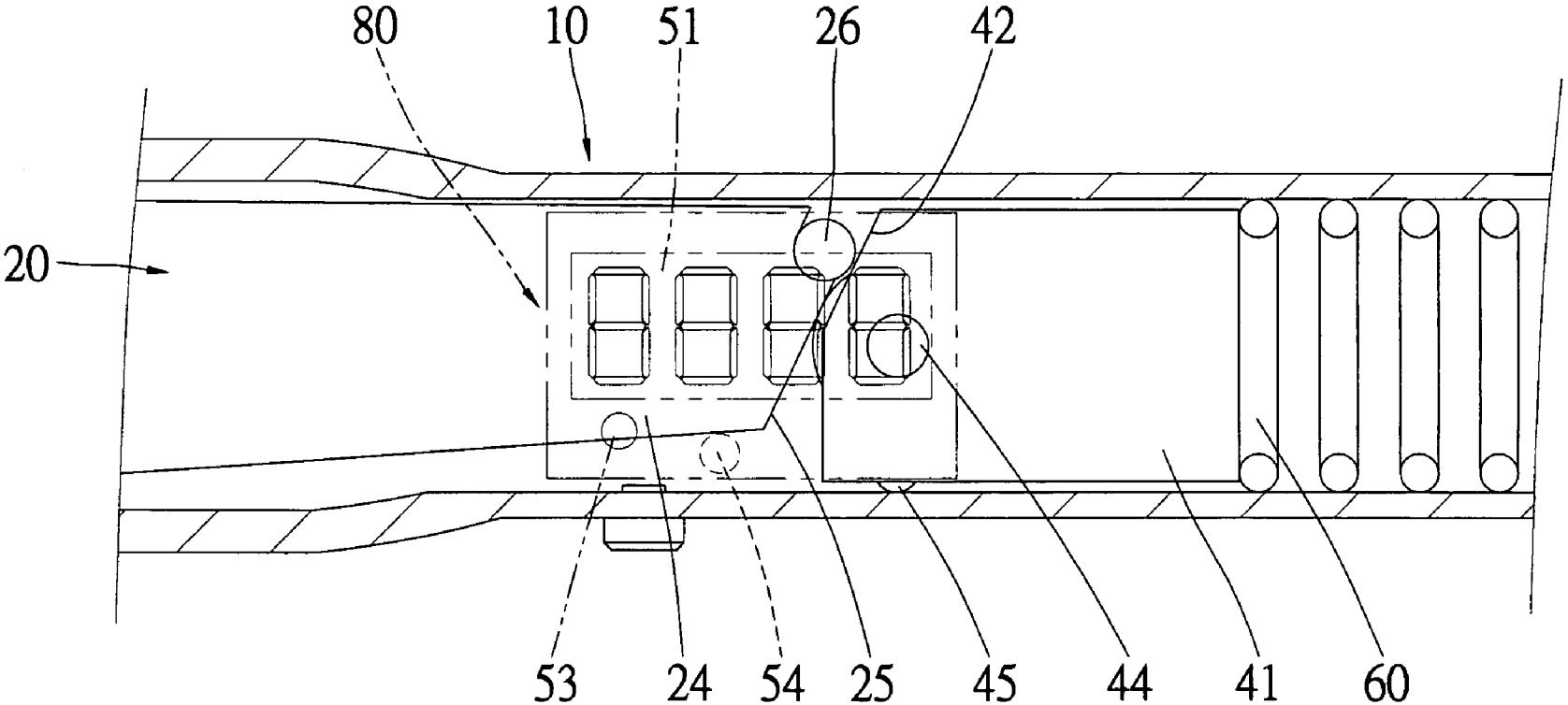
FIG. 8 is an enlarged cross-sectional view of the wrench of FIG. 7.
Figure 9:
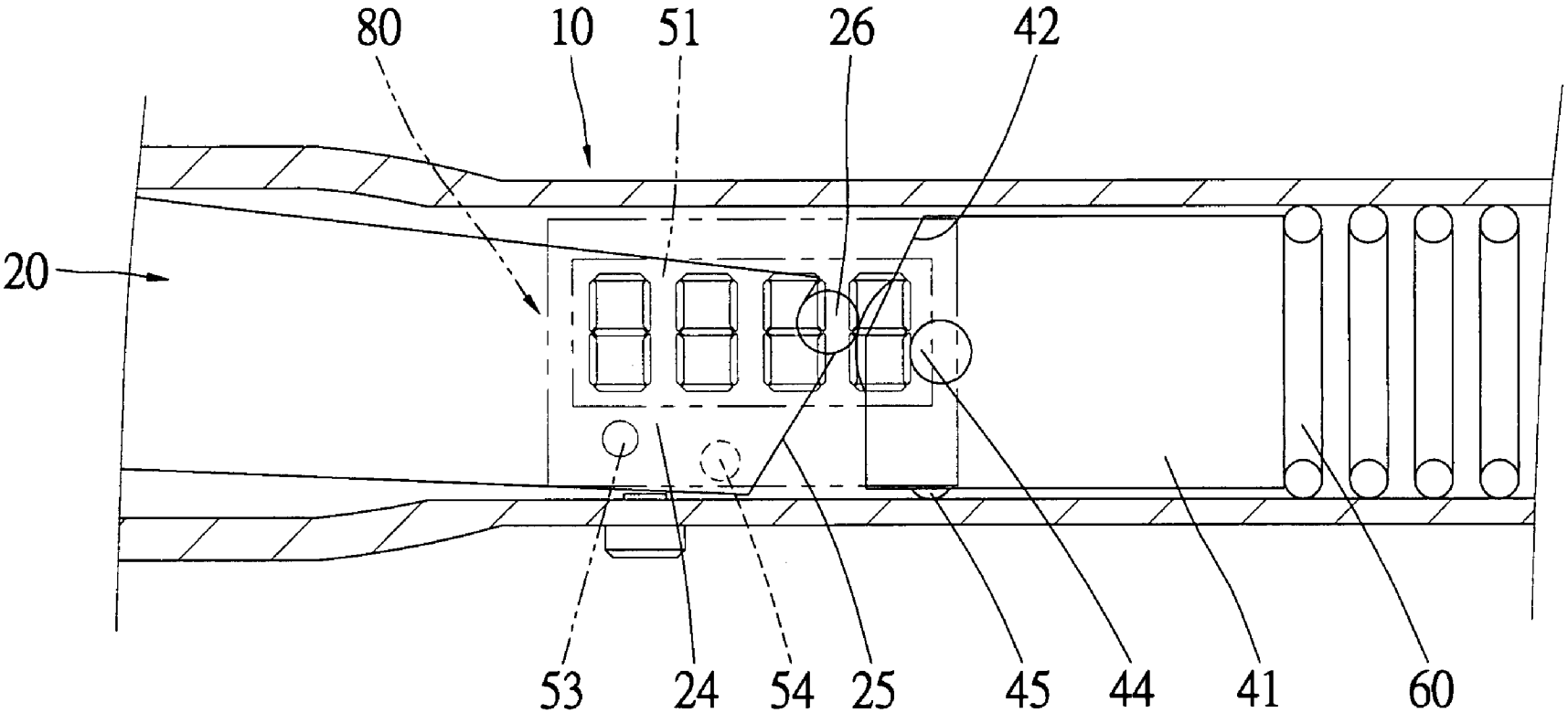
FIG. 9 is similar to FIG. 8 but shows the wrench in another position.
Figure 10:
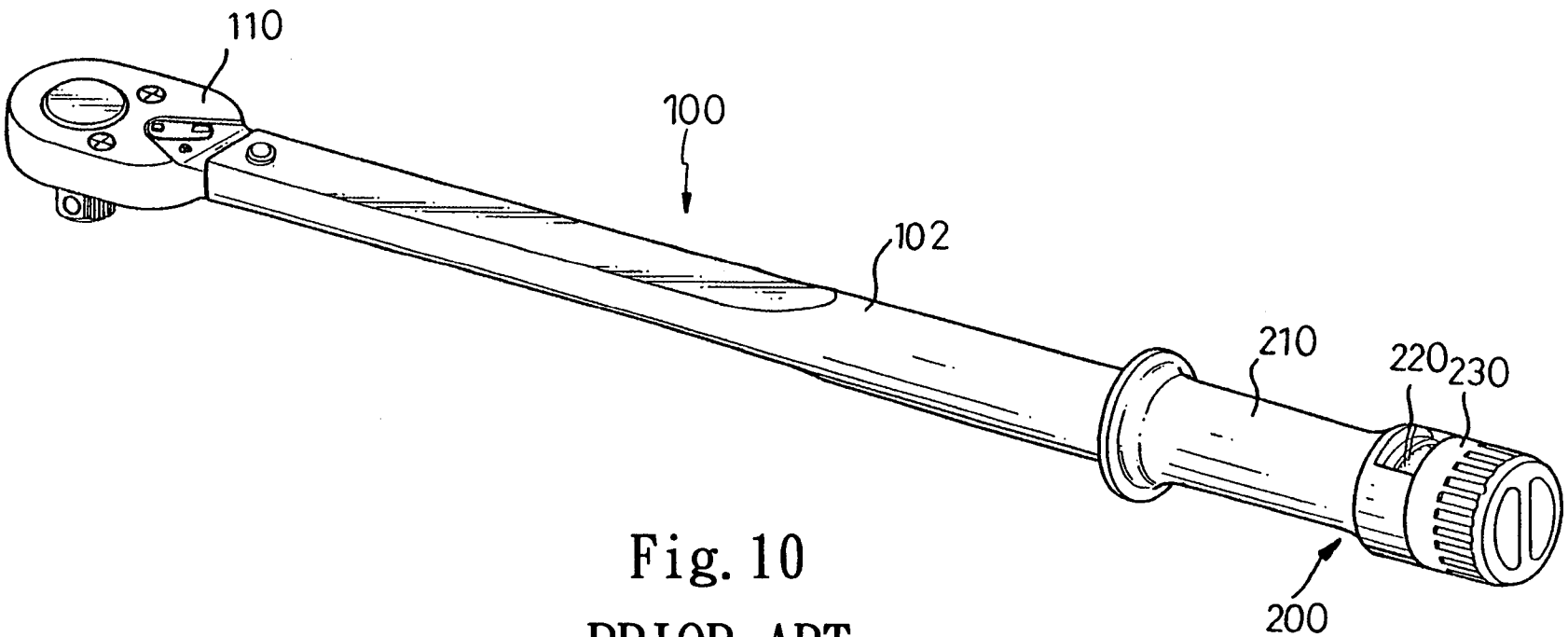
Fig. 10 PRIOR ART
FIG. 10 is a perspective view of a conventional wrench that provides a reading of torque exerted on a bolt or nut via the wrench.
Figure 11:
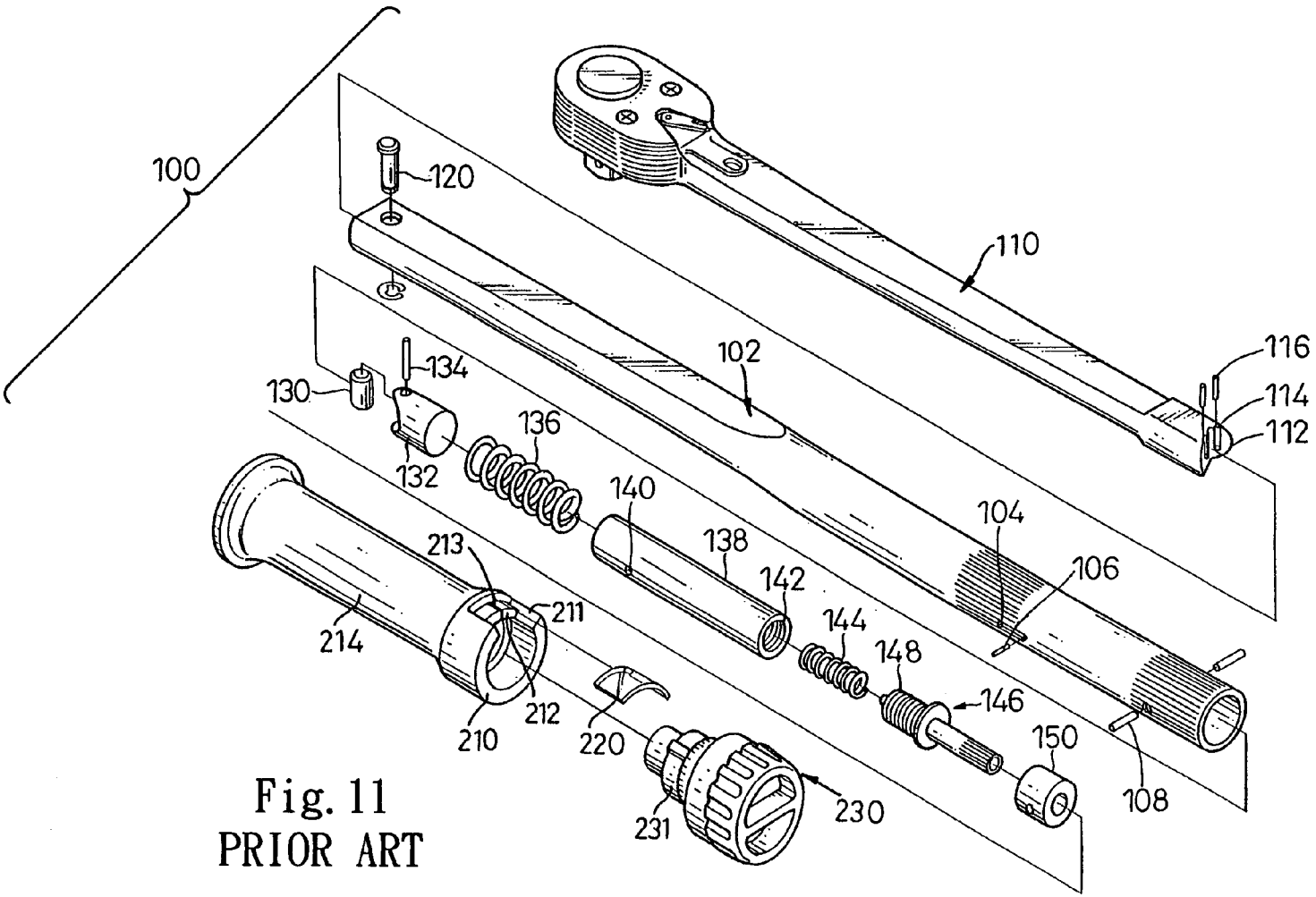
Fig. 11 PRIOR ART
FIG. 11 is an exploded view of the wrench of FIG. 11.
Figure 12:
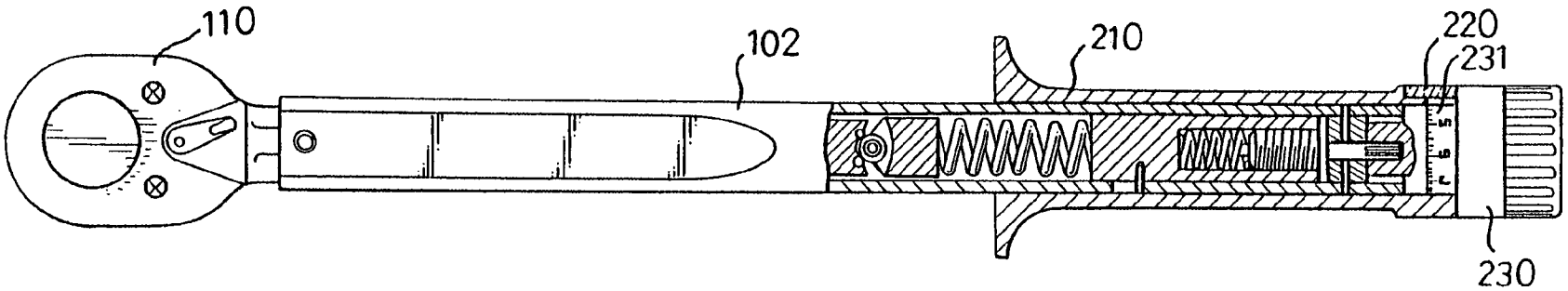
Fig. 12 PRIOR ART
FIG. 12 is a cross-sectional view of the wrench of FIG. 11.

FIGS. 7–9 show a wrench that counts the number of times its torque reaches set values according to a third embodiment of the present invention. The third embodiment is identical to the first embodiment except for using a counter 80 instead of the electrical counter 50. The counter 80 is identical to the electrical counter 50 except for including an infrared sensor 54 instead of the sensor 52. The infrared sensor 54 is not movable together with the wedge 24. Hence, the hole 27 is omitted.

The present invention has been described via detailed illustration of three embodiments. Those skilled in the art can derive variations from the embodiments without departing from the scope of the present invention. Therefore, the embodiments shall not limit the scope of the present invention defined in the claims.

What is claimed is:

1. A wrench comprising a pipe, a lever with a portion in the pipe and pivotally connected with the pipe, a first wedge attached to the portion of the lever, a second wedge in contact with the first wedge, an elastic element for biasing the second wedge against the first wedge, a counter installed on the pipe and a sensor signaling the counter every time movement of the first wedge past the second wedge is sensed, wherein the pipe includes a first open end and a second end opposite to the first open end, with the lever extending into the first open end and pivotally connected with the pipe adjacent to the first open end, and wherein the pipe defines a transverse slot through which the sensor extends from the counter into the pipe, with the transverse slot being transverse to a direction extending between the first open end and the second end.

2. The wrench according to claim 1 wherein the counter is an electrical counter.

3. The wrench according to claim 2 wherein the sensor is in the form of a trigger.

4. The wrench according to claim 2 wherein the sensor is an infrared sensor.

5. The wrench according to claim 1 wherein the counter is a mechanical counter.

6. The wrench according to claim 1 wherein the first wedge includes an inclined face, and the second wedge includes an inclined face for contact with die inclined face of the first wedge.

7. The wrench according to claim 6 wherein the inclined face of the first wedge includes a roller for rolling contact with the inclined face of the second wedge.

8. The wrench according to claim 6 wherein the inclined face of die second wedge includes a roller for rolling contact with the inclined face of the first wedge.

9. The wrench according to claim 8 wherein the second wedge is in the form of a collar with two inclined edges that together form the inclined face.

10. The wrench according to claim 9 comprising a pin for attaching the roller to the second wedge.

11. The wrench according to claim 6 wherein the inclined face of the first wedge includes a roller for rolling contact with the inclined face of the second wedge and the inclined face of the second wedge includes a roller for rolling contact with the inclined face of the first wedge.

12. The wrench according to claim 1 comprising a grip attached to the pipe for retaining the elastic element in the pipe.

13. The wrench according to claim 12 wherein the grip comprises a hollow configuration put around the pipe.

14. The wrench according to claim 13 wherein the grip comprises on an internal face a thread, and the pipe comprises on an external face a thread for engagement with the thread of the grip.

* * * * *